US009850739B2

(12) United States Patent
Ferguson et al.

(10) Patent No.: US 9,850,739 B2
(45) Date of Patent: Dec. 26, 2017

(54) CEMENT HEAD STABBER AND METHOD FOR LIFTING FOR INSTALLATION

(71) Applicants: George Pat Ferguson, Ida, LA (US); Warren J. Diamond, Giddings, TX (US)

(72) Inventors: George Pat Ferguson, Ida, LA (US); Warren J. Diamond, Giddings, TX (US)

( * ) Notice: Subject to any disclaimer, the term of this patent is extended or adjusted under 35 U.S.C. 154(b) by 673 days.

(21) Appl. No.: 14/465,061

(22) Filed: Aug. 21, 2014

(65) Prior Publication Data

US 2016/0052749 A1 Feb. 25, 2016

(51) Int. Cl.
*E21B 33/14* (2006.01)
*E21B 33/05* (2006.01)

(52) U.S. Cl.
CPC ..... *E21B 33/14* (2013.01); *E21B 33/05* (2013.01)

(58) Field of Classification Search
CPC ..... E21B 33/143; E21B 33/14; E21B 33/16; E21B 33/146; E21B 33/13; B66C 13/06
USPC ..... 166/379, 237; 294/81.3, 67.21, 67.5
See application file for complete search history.

(56) References Cited

U.S. PATENT DOCUMENTS 3,955,844 A * 5/1976 de Castella ..... B66C 1/105 212/195
4,626,012 A * 12/1986 Weldele ..... B66C 1/10 294/67.1
6,182,752 B1 2/2001 Smith, Jr. et al.
7,874,352 B2 1/2011 Odell, II et al.
8,840,158 B2 * 9/2014 Leibovitz ..... B66C 1/105 294/67.5
2013/0284457 A1 10/2013 Laurel et al.

* cited by examiner

*Primary Examiner* — David Bagnell
*Assistant Examiner* — Nikhil Menon
(74) *Attorney, Agent, or Firm* — Kinney & Lange, P.A.

(57) ABSTRACT

A stabber for assisting in the lifting and installation of a cement head assembly onto a bore hole casing includes a support member comprising a first end opposite a second end. A first connection element is disposed proximate the first end of the support member and a second connection element is disposed proximate the second end of the support member. A first weight is mounted to the support member in closer proximity to the second end of the support member than to the first end of the support member. A second weight is connected to the support member between the first and second ends of the support member.

19 Claims, 4 Drawing Sheets

CEMENT HEAD STABBER AND METHOD FOR LIFTING FOR INSTALLATION

BACKGROUND

The present disclosure relates to cementing operations in subterranean drilling. More particularly, the present disclosure relates to an apparatus and method for installing a cement head on borehole casing.

In oil and gas drilling, a casing is placed inside the open borehole to maintain borehole stability and to control formation pressures. In many of these boreholes, an intermediate casing is installed and cemented into place. After the intermediate casing is installed, drilling can be continued through this casing to a deeper depth. Formations outside the intermediate casing are thus isolated, which helps to eliminate borehole cave-in and helps to contain formation pressures and fluids.

To cement the casing into a drilled borehole, a cement head is installed on the casing. The cement head contains hoses and piping to transfer cement and water from pumps to the inside of the casing. The cement head also contains valves to launch a rubber wiper plug down inside the casing. Once the cement head is installed on the casing, a precalculated volume of cement is pumped into the cement head, down the inside of the casing, and up the outside of the casing to the surface. Once the cement is pumped inside the casing, the rubber wiper plug is installed inside the casing on top of the cement slurry. Water is then pumped inside the casing to push the wiper plug downwards and thereby displace the cement slurry from the inside of the casing to the outside of the casing. Once adequate time has expired for cement curing, the plug can be drilled out and drilling to deeper depths can continue.

In many cases, cement heads must be positioned high above the rig floor during cementing operations. Installing a cement head on the case in such instances generally requires a crane or winch to raise the cement head to the case. Frequently, personnel must be hoisted off the rig floor using a makeshift seat or harness attached to a winch or other lifting device in order to reach the cement head and case to connect the cement head to the case. In addition to connecting the cement head to the case, the personnel attach pipes and pipe fittings to the cement head to connect the cement head to pumps located on the ground. Such personnel are at risk of falling. Moreover, such personnel are frequently required to carry heavy bars, wrenches and other tools used to manipulate both the cement head and the pipes and fittings that they attach to the cement head. These bars, wrenches and other heavy tools are at risk of being accidentally dropped onto the rig floor below.

SUMMARY

In one aspect of the present disclosure, an assembly includes a stabber. The stabber includes a support beam comprising a first end opposite a second end. A first connection flange is disposed at the first end of the support beam and a second connection flange is disposed at the second end of the support beam. A weight is mounted to the support beam intermediate the second end of the support beam and a midpoint of the support beam. The assembly also includes a cement head connected to the first connection flange of the support beam. The cement head comprises a cement inlet. The assembly also includes a cement line comprising a first end connected to the cement inlet of the cement head and a second end configured for connection to a cement pump. The cement line is connected to the second connection flange of the support beam between the first end of the cement line and the second end of the cement line.

In another aspect of the present disclosure, a stabber for assisting in the lifting and installation of a cement head assembly onto a bore hole casing includes a support member comprising a first end opposite a second end. A first connection element is disposed proximate the first end of the support member and a second connection element is disposed proximate the second end of the support member. A first weight is mounted to the support member in closer proximity to the second end of the support member than to the first end of the support member. A second weight is connected to the support member between the first and second ends of the support member.

In yet another aspect of the present disclosure, a method for lifting a cement head for installation onto a borehole casing includes connecting a first end of a cement line to a cement inlet of the cement head. The method also includes connecting a first end of a support beam to the cement head. A second end of the support beam is connected to the cement line between the first end of the cement line and a second end of the cement line. The first end and the second end of the support beam are connected to a crane and the support beam is pulled upward by the crane such that the support beam simultaneously pulls the cement head and the cement line upward.

Persons of ordinary skill in the art will recognize that other aspects and embodiments of the present disclosure are possible in view of the entirety of the present disclosure, including the accompanying figures.

Figure 1A:
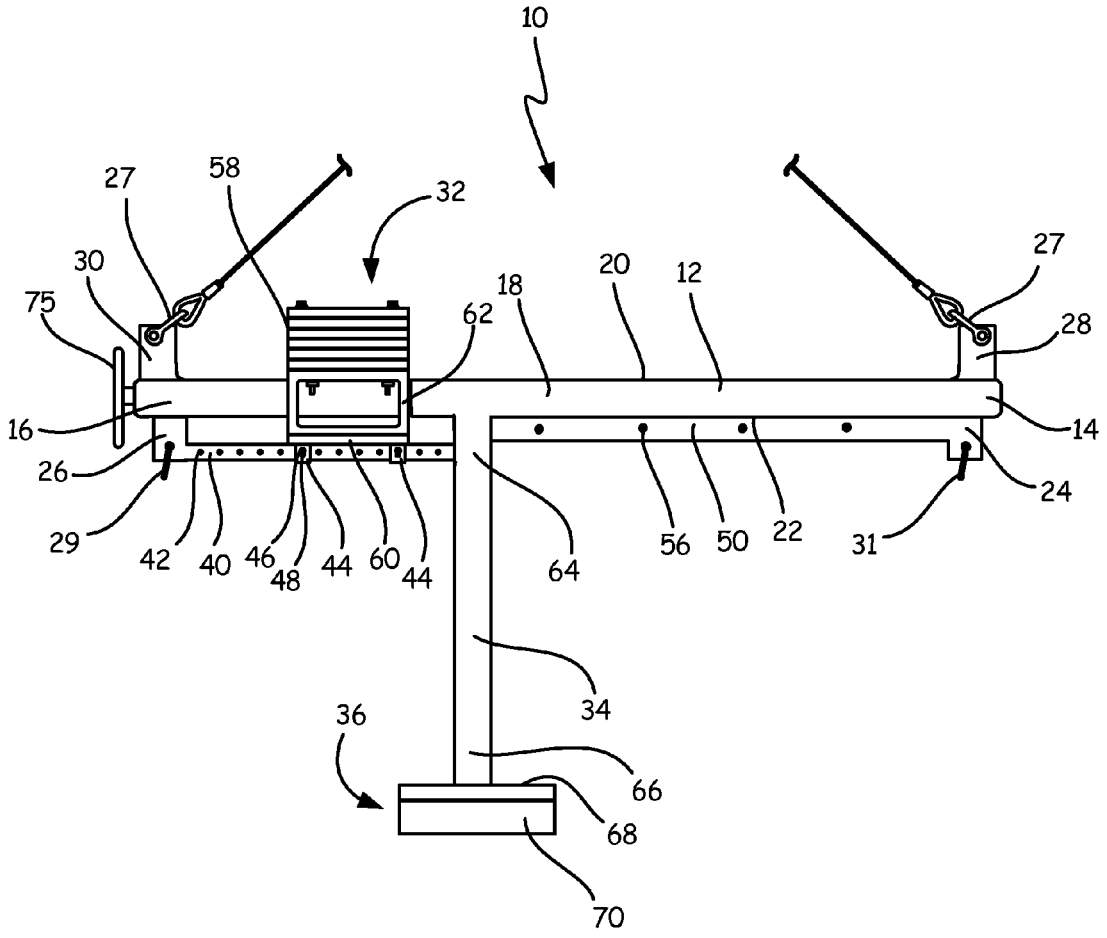
FIG. 1A is a side view of a stabber for lifting a cement head.

While the above-identified drawing figures set forth one or more embodiments of the present disclosure, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides a stabber for lifting a cement head and a cement line simultaneously by a single lift point. The stabber balances the cement head and the cement line while both the cement head and the cement line are raised to a borehole casing. Because the stabber lifts both the cement head and the cement line, the cement line can be assembled on the ground, thereby reducing both the risk of workers or tools falling and the time needed to assemble the cement line to the cement head.

Figure 1B:
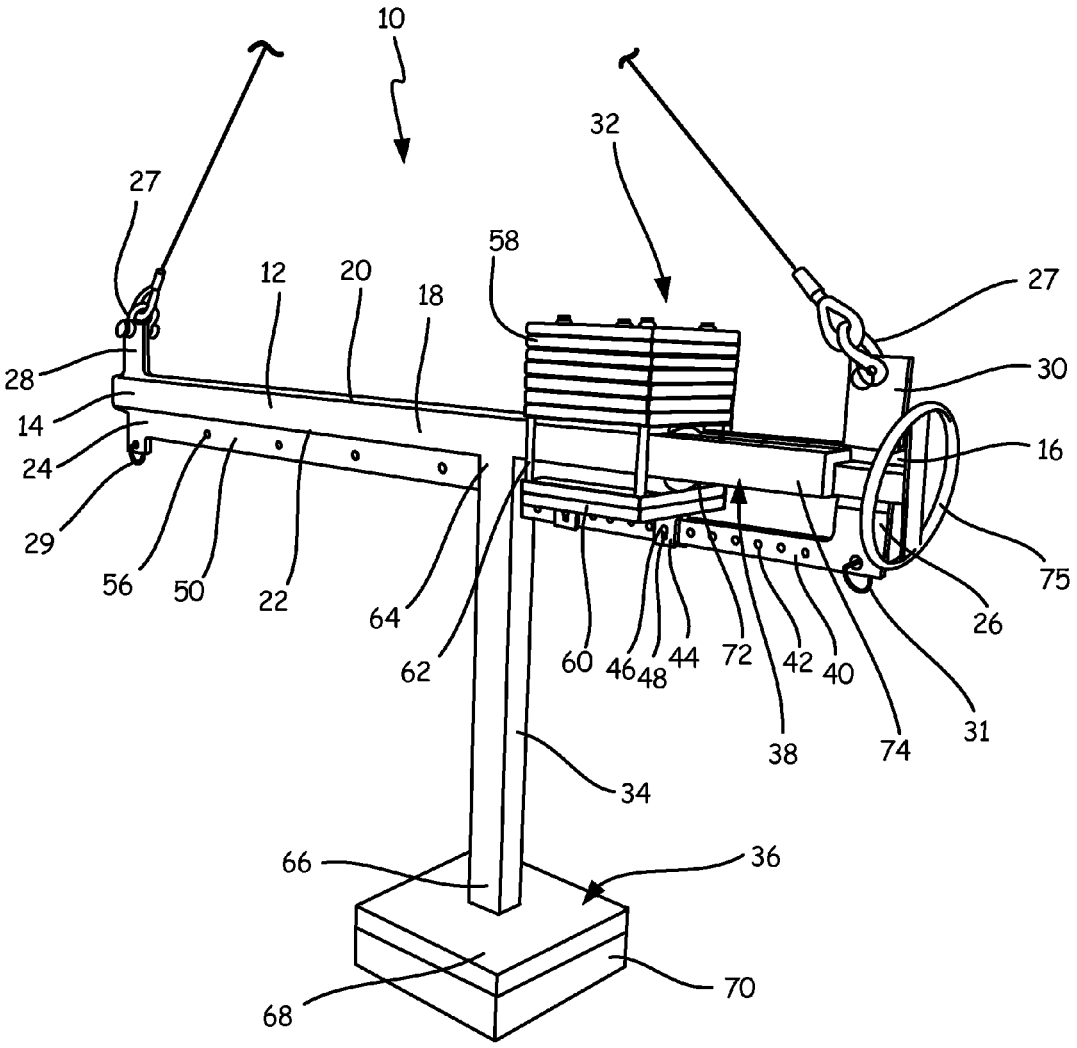
FIG. 1B is a perspective view of the stabber of FIG. 1A.

FIGS. 1A and 1B will be discussed concurrently. FIG. 1A is a side view of stabber 10, and FIG. 1B is a perspective view of stabber 10 of FIG. 1A. As shown in FIGS. 1A and 1B, stabber 10 includes support member 12. Support member 12 includes first end 14, second end 16, midpoint 18, top side 20, and bottom side 22. Stabber 10 can also include first connection element 24, second connection element 26, third connection element 28, fourth connection element 30, first weight 32, base beam 34, second weight 36, actuator 38, locking rail 40 with holes 42, locking flange 44 with pinhole 46, pin 48, and fifth connection element 50 with holes 56. First weight 32 can include top plates 58, bottom plate 60, and connecting rods 62. Base beam 34 can include first end 64 and second end 66. Second weight 36 can include block 68 and box 70. Block 68 can be a concrete block and box 70 can be a metal box. Actuator 38 can be a worm drive that includes rack 72, worm 74, and turn wheel 75.

Support member 12 can be a beam extending between first end 14 and second end 16 such that first end 14 is opposite second end 16. As shown in FIGS. 1A and 1B, support member 12 can be formed from square steel tubing. In other embodiments, support member 12 can be formed from titanium, aluminum, or any other material with the tensile strength and stiffness suitable for forming support member 12. First connection element 24 can be disposed proximate first end 14 of support member 12. First connection element 24 can be a flange extending from bottom side 22 of support member 12 at first end 14 of support member 12. First connection element 24 can include connection hardware 29 that can be used to connect first end 14 of support member 12 to a cement head (shown in FIGS. 2 and 3). Connection hardware 29 can comprise a D-ring, a U-bolt, a hook, a karabiner, a bolt, and/or combinations thereof. Second connection element 26 can be disposed proximate second end 16 of support member 12. Second connection element 26 can be a flange extending from bottom side 22 of support member 12 at second end 16 of support member 12. Second connection element 26 can include connection hardware 31 that can be used to connect second end 16 of support member 12 to a cement line (shown in FIGS. 2 and 3). Connection hardware 31 can comprise a D-ring, a U-bolt, a hook, a karabiner, a bolt, and/or combinations thereof.

Third connection element 28 can be disposed proximate first end 14 of support member 12. Third connection element 28 can be a flange extending from top side 20 of support member 12 at first end 14 of support member 12. Fourth connection element 30 can be disposed proximate second end 16 of support member 12. Fourth connection element 30 can also be a flange extending from top side 20 of support member 12 at second end 16 of support member 12. Both third connection element 28 and fourth connection element 30 can include connection hardware 27 that can be used to connect first end 14 and second end 16 of support member 12 to a crane or lift (shown in FIGS. 3 and 4). Connection hardware 27 can comprise a D-ring, a U-bolt, a hook, a karabiner, a bolt, and/or combinations thereof.

As shown in FIGS. 1A and 1B, first connection element 24, second connection element 26, third connection element 28, and fourth connection element 30 can be distinct elements from one another. In an alternative embodiment of the present disclosure, first connection element 24 and third connection element 28 can comprise a single connection element configured to connect first end 14 of support member 12 to both a cement head and a crane. Second connection element 26 and fourth connection element 40 can comprise a single connection element configured to connect second end 16 of support member 12 to both a cement line and a crane.

First weight 32 can be mounted to support member 12 intermediate second end 16 of support member 12 and midpoint 18 of support member 12 such that first weight 32 is in closer proximity to second end 16 of support member 12 than to first end 14 of support member 12. Midpoint 18 can be defined as a point on support member 12 that is equidistant from first end 14 and second end 16 of support member 12. Top plates 58 of first weight 32 can be a plurality of stacked metal plates disposed on top side 20 of support member 12. Bottom plate 60 can be disposed on bottom side 22 of support member 12 opposite top plates 58. Connecting rods 62 can extend from bottom plate 60 toward top plates 58 and can connect bottom plate 60 to top plates 58. Top plates 58 and bottom plate 60 of first weight 32 can be configured to slide on support member 12 in the region between second end 16 of support member 12 and midpoint 18 of support member 12.

Base beam 34 can be connected to bottom side 22 of support member 12 between first end 14 and second end 16 and can extend downward from support member 12. As shown in FIGS. 1A and 1B, base beam 34 can be connected to support member 12 between midpoint 18 of support member 12 and first weight 32. First end 64 of base beam 34 is connected to bottom side 22 of support member 12 and second end 66 of base beam 34 is disposed opposite first end 64 of base beam 34. Similar to support member 12, base beam can be formed from square tubing of the same material as support member 12. Second weight 36 can be connected to second end 66 of base beam 34 such that base beam 34 connects second weight 36 to support member 12 between first and second ends 14, 16 of support member 12. Second weight 36 can be formed from block 68 disposed within box 70. Second weight 36 can be heavier than first weight 32 so that second weight 36 and base beam 34 can maintain support beam 12 substantially horizontal when second weight 36 is resting on the ground.

Actuator 38 can be connected to support member 12 and configured to translate and control the position of first weight 32 on support member 12 between second end 86 of support member 12 and midpoint 18 of support member 12. Actuator 38 can be a worm drive that includes both rack 72 connected to second weight 36, and worm 74 connected to support member 12 and meshed with rack 72. Turn wheel 75 can be connected to worm 74 and used by an operator to turn worm 74 and adjust the position of first weight 32 on support member 12. Locking rail 40 can extend relatively parallel to support member 12 from second end 16 of support member 12 to base beam 34. As shown in FIGS. 1A and 1B, locking rail 40 is connected to the flange of fourth connection element 30 and base beam 34. Locking rail 40 can include holes 42, holes 42 being spaced across a length of locking rail 40. Locking flange 44 can be connected to bottom plate 60 of first weight 32 and can extend toward locking rail 40 to engage locking rail 40. Locking flange 44 can include pin hole 46. As first weight 32 is positioned on support member 12 by actuator 38, pin hole 46 of locking flange 44 can be aligned with one of holes 42 of locking rail 40 such that pin 48 can be inserted into pin hole 46 and one of holes 42 of locking rail 40 to lock the position of first weight 32 on support member 12 to prevent first weight 32 from shifting position during the use of stabber 10.

Fifth connection element 50 can be a flange connected to bottom side 22 of support member 12 and extending from third connection element 28 toward base beam 34. Fifth connection element 50 can include holes 56 spaced along a length of fifth connection element 50. During the use of stabber 10, holes 56 of fifth connection element can provide multiple redundant connection points between stabber 10 and a cement head. The use and operation of stabber 10 is discussed in greater detail below with reference to FIGS. 2 and 3.

Figure 2:
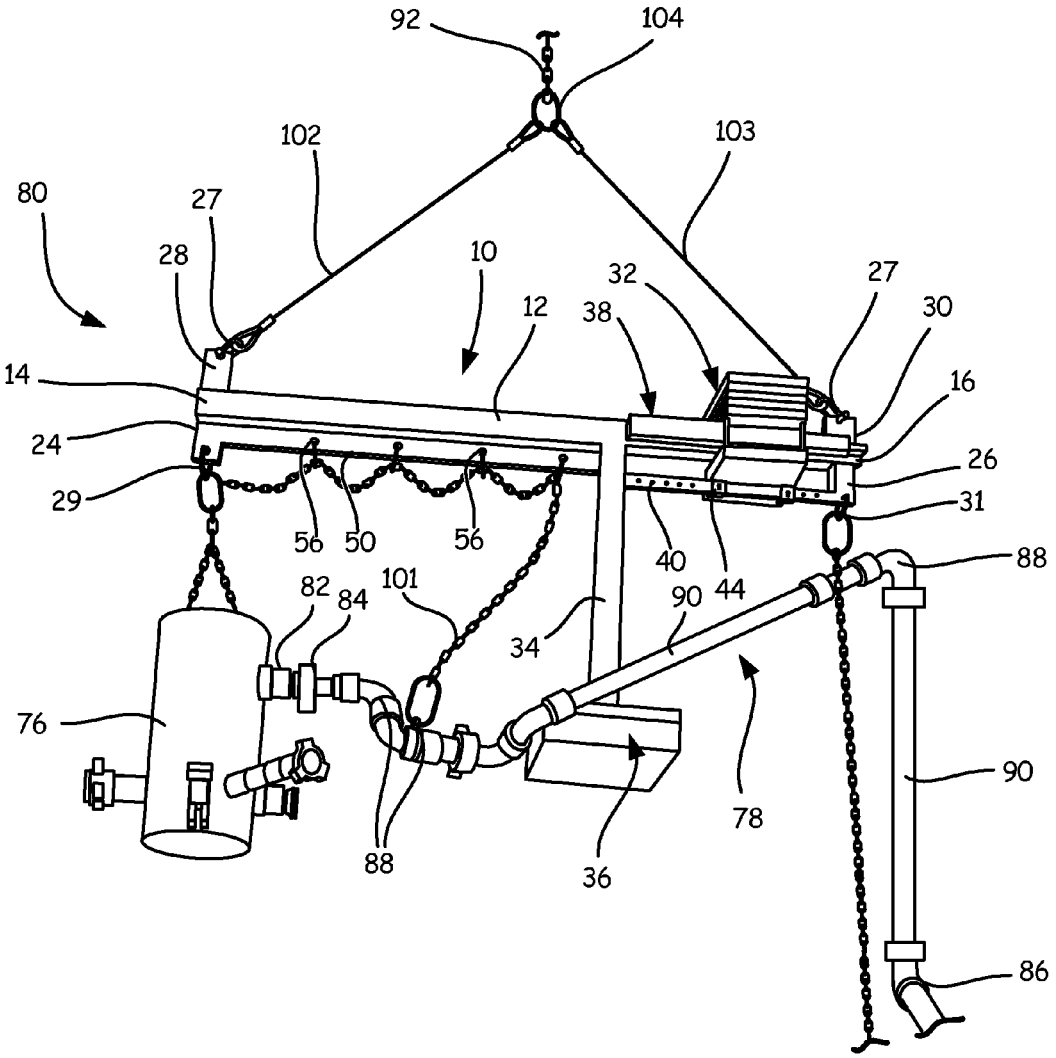
FIG. 2 is a perspective view of the stabber of FIG. 1A connected to a crane, a cement head, and a cement line.
Figure 3:
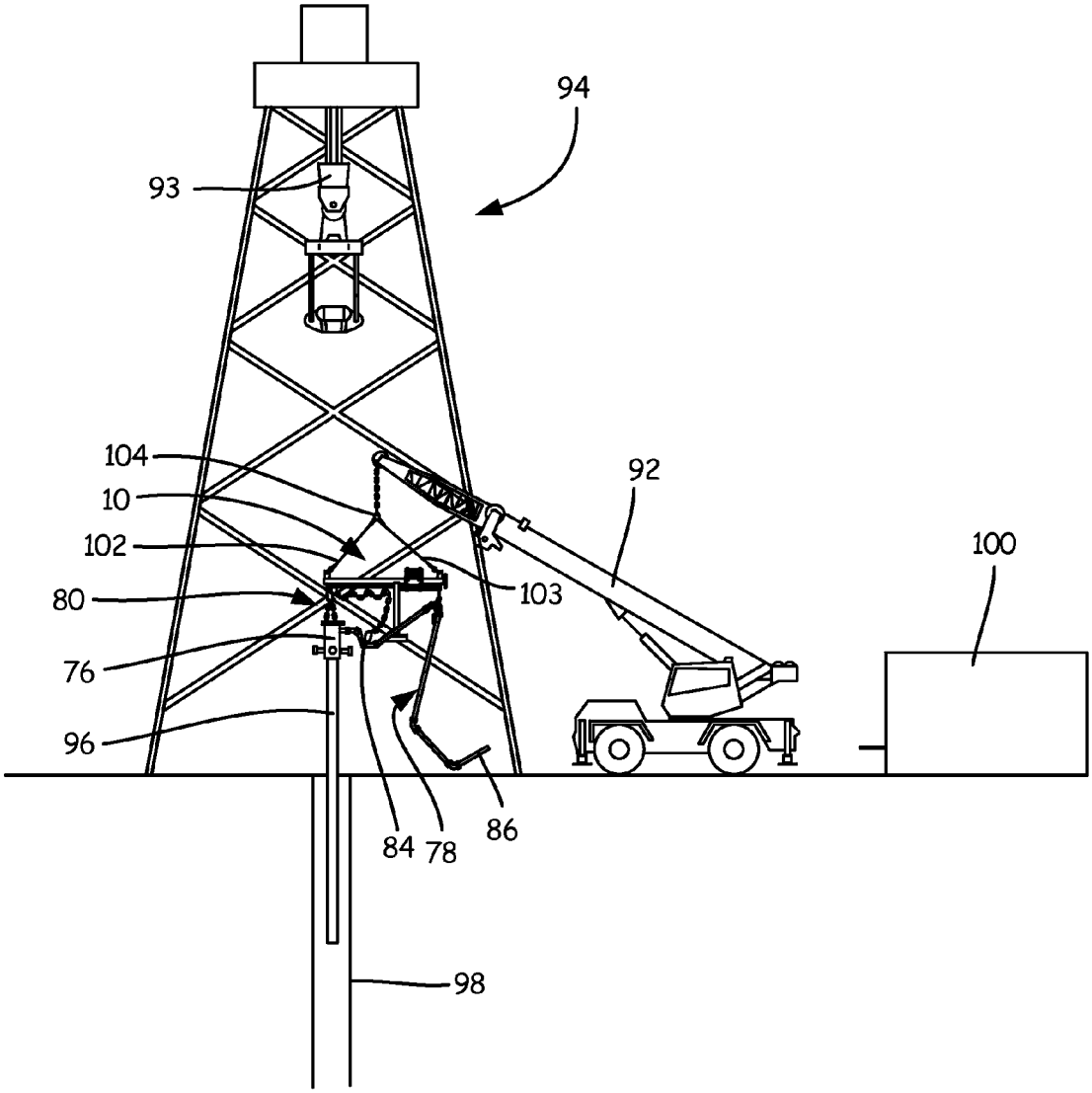
FIG. 3 is a schematic view of a drilling rig and a borehole, and a cement head being installed on a well casing of the borehole with the assistance of a crane and the stabber of FIGS. 1A and 1B.

FIGS. 2 and 3 will be discussed concurrently. In FIGS. 2 and 3, components of like numbering with the components of FIGS. 1A and 1B are assembled as discussed above with reference to FIGS. 1A and 1B. As shown in FIGS. 2 and 3, stabber 10 can be connected to cement head 76 and cement line 78 to form assembly 80. Cement head 76 can include inlet 82. Cement line 78 can include first end 84, second end 86, fittings 88, and pipes 90. Crane 92 or lift 93 of drilling rig 94 can be used to raise assembly 80 to connect cement head 76 to borehole casing 96 disposed in borehole 98. FIGS. 2 and 3 also disclose cement pump 100 that is ultimately connected to cement line 78 to deliver cement and/or water to cement head 76.

Before cement head 76 and cement line 78 are lifted via stabber 10 by crane 92 or lift 93, fittings 88 and pipes 90 are assembled together to form cement line 78 and first end 84 of cement line 78 is connected to inlet 82 of cement head 76. The assembly of cement line 78 and cement head 76 can be carried out on the ground or on a platform of drilling rig 94. Before cement head 76 and cement line 78 are lifted via stabber 10 by crane 92 or lift 93, cement head 76 is connected to third connection element 28 at first end 14 of support beam 12 and cement line 78 is connected to fourth connection element 30 at second end 16 of support member 12 between first end 84 of cement line 78 and second end 86 of cement line 78. Cement head 76 and cement line 78 can also be connected to holes 56 of fifth connection element 50 by chain 101 to reduce the likelihood of cement head 76 and cement line 78 from falling from stabber 10 in the event third connection element 28 or fourth connection element 30 failed during use of assembly 80.

Both first end 14 and second end 86 of support member 12 can be connected to crane 92. As shown in FIGS. 2 and 3, first end 14 of support member 12 can be connected to crane 92 by cable 102 which can be connected to connection hardware 27 of third connection element 28 and connection point 104 of crane 92. Second end 16 of support member 12 can be connected to crane 92 by cable 103 which can be connected to connection hardware 27 of fourth connection element 30 and connection point 104 of crane 92. As crane 92 pulls connection point 104 upward, cable 102 and cable 103 simultaneously pull first end 14 and second end 16 of support member 12 upward. As crane 92 pulls support beam 12 upward, crane 92 and support beam 12 can simultaneously pull cement head 76 and cement line 78 upward. Before crane 92 pulls support beam 12, cement head 76 and cement line 78 completely out of reach from personnel on the ground, an operator can adjust the position of first weight 32 on support beam 12 such that first weight 32 counterbalances cement head 76 so that support beam 12 extends substantially horizontal relative ground as support beam 12 is pulled upward by crane 92. The operator can also remove turn wheel 75 (shown in FIGS. 2 and 3) from actuator 38 to prevent turn wheel 75 from hitting another object, such as the tower of drilling rig 94, and inadvertently changing the position of first weight 32 on support member 12 as crane 92 raises assembly 80 toward borehole casing 96.

As crane 92 raises assembly 80, second weight 36 can assist first weight 32 in counterbalancing the weight of cement head 76. Because second weight 36 is connected to second end 66 of base beam 34 and disposed support member 12 between cement head 76 and first weight 32, as shown in FIGS. 2 and 3, second weight 36 can assist in dampening stabber 10 against any swinging that might occur as assembly 80 is raised off the ground by crane 92. Once crane 92 has raised assembly 80 off the ground, crane 92 can move assembly 80 toward borehole casing 96 so that cement head 76 can be connected to borehole casing 96. Once cement head 76 has been connected to borehole casing 96, personnel on the ground can connect second end 86 of cement line 78 to cement pump 100 so that cement pump 100 can proceed to pump cement and/or water across cement line 78, into cement head 76, and into borehole casing 96.

In view of the foregoing description, it will be recognized that the present disclosure provides numerous advantages and benefits. For example, the present disclosure provides stabber 10 which is configured to assist crane 92, or another lifting device, in simultaneously lifting cement head 76 and cement line 78. Because stabber 10 assists crane 92 in lifting cement head 76 and cement line 78 simultaneously, cement line 78 can be assembled and connected to cement head 76 on the ground before cement head 76 is connected atop borehole casing 96 where it may be harder and more precarious to reach cement head 76. Stabber 10 also includes first weight 32 and second weight 36 which assist in balancing stabber 10, cement head 76, and cement line 78, thereby making it easier for an operator to control cement head 76 as it is lifted to borehole casing 96 and installed on borehole casing 96.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while the specification describes first connection element 24, second connection element 26, third connection element 28, and fourth connection element 30 as being flanges, these connection elements 24, 26, 28, 30 can also be embodied as metal loops connected to support member 12. Furthermore, while the specification describes first connection element 24, second connection element 26, third connection element 28, and fourth connection element 30 as elements distinct from one another, first and third connection elements 24, 28 can be merged into a single connection element, and second and fourth elements 26, 30 can be merged into a single connection element. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly comprising:

a stabber, the stabber comprising:

a support beam comprising a first end opposite a second end;

a first connection element disposed at the first end of the support beam;

a second connection element disposed at the second end of the support beam; and a weight mounted to the support beam intermediate the second end of the support beam and a midpoint of the support beam;

a cement head connected to the first connection element of the support beam, wherein the cement head comprises a cement inlet; and a cement line comprising a first end connected to the cement inlet of the cement head and a second end configured for connection to a cement pump, wherein the cement line is connected to the second connection element of the support beam between the first end of the cement line and the second end of the cement line.

2. The assembly of claim 1, wherein the stabber further comprises:

a base beam extending downward from the support beam, wherein the base beam comprises:

a first end connected to the support beam between the first and second ends of the support beam; and a second end disposed opposite the first end; and a second weight connected to the second end of the base beam.

3. The assembly of claim 2, wherein the second weight comprises a block disposed within a box.

4. The assembly of claim 3, wherein the stabber further comprises:

an actuator configured to translate the weight on the support beam between the second end of the support beam and the midpoint of the support beam.

5. The assembly of claim 3, wherein the stabber further comprises:

a locking rail extending from the second end of the support beam to the base beam, wherein the locking rail comprises a plurality of holes.

6. The assembly of claim 5, wherein the stabber further comprises:

a locking flange that is connected to the weight and that engages the locking rail, wherein the locking flange includes a pin hole; and a pin disposed in the pin hole and one of the plurality of holes of the locking rail.

7. The assembly of claim 3, wherein the stabber further comprises:

a connection flange connected to the support beam and extending from the first end of the support beam toward the base beam, wherein the connection flange comprises a plurality of holes.

8. The assembly of claim 2, wherein the weight is mounted to the support beam and configured to slide on the support beam in a region located between the second end of the support beam and the midpoint of the support beam.

9. The assembly of claim 1, wherein the weight comprises a plurality of stacked metal plates.

10. A stabber for assisting in the lifting and installation of a cement head assembly onto a bore hole casing, the stabber comprising:

a support member comprising a first end opposite a second end;

a first connection element disposed proximate the first end of the support member;

a second connection element disposed proximate the second end of the support member;

a first weight mounted to the support member in closer proximity to the second end of the support member than to the first end of the support member;

a second weight connected to the support member between the first and second ends of the support member; and a base beam extending downward from the support member, wherein the base beam comprises:

a first end connected to the support member between the first and second ends of the support member; and a second end disposed opposite the first end, wherein the second weight is connected to the second end of the base beam.

11. The stabber of claim 10, wherein the first weight is mounted to the support member and configured to slide on the support member in a region located between the second end of the support member and a midpoint of the support member.

12. The stabber of claim 11, wherein the first weight comprises:

a plurality of top plates disposed on a top side of the support member;

a bottom plate disposed on a bottom side of the support member; and at least one connecting rod extending from the bottom plate toward the plurality of top plates and connecting the bottom plate to at least one of the plurality of top plates.

13. The stabber of claim 12, wherein the stabber further comprises:

a locking rail extending from the second end of the support member to the base beam and parallel to the support member, wherein the locking rail comprises a plurality of holes.

14. The stabber of claim 13, wherein the stabber further comprises:

a locking flange connected to the bottom plate of the first weight and that engages the locking rail, wherein the locking flange includes a pin hole; and a pin disposed in the pin hole and one of the plurality of holes of the locking rail.

15. The stabber of claim 11, wherein the stabber further comprises:

a worm drive configured to translate the first weight on the support member between the second end of the support member and the midpoint of the support member.

16. The stabber of claim 15, wherein the worm drive comprises:

a rack connected to the second weight; and a worm connected to the support member and meshed with the rack.

17. The stabber of claim 10, wherein the second weight is heavier than the first weight mounted to the support member.

18. A method for lifting a cement head for installation onto a borehole casing, the method comprising:

connecting a first end of a cement line to a cement inlet of the cement head;

connecting a first end of a support beam to the cement head;

connecting a second end of the support beam to the cement line between the first end of the cement line and a second end of the cement line;

connecting the first end and the second end of the support beam to a crane; and pulling the support beam upward by the crane such that the support beam simultaneously pulls the cement head and the cement line upward.

19. The method of claim 18 further comprising:

adjusting a position of a weight mounted on the support beam such that the weight counter balances the cement head so that the support beam extends substantially horizontal relative ground as the support beam is pulled upward by the crane.

* * * * *